US006840188B1

(12) United States Patent
Witbeck

(10) Patent No.: US 6,840,188 B1
(45) Date of Patent: Jan. 11, 2005

(54) TOWED TRANSPORT, LAUNCH AND RECOVERY RAFT

(75) Inventor: Norman C. Witbeck, Washington, DC (US)

(73) Assignee: Columbia Research Corporation, Washington, DC (US)

( * ) Notice: Subject to any disclaimer, the term of this patent is extended or adjusted under 35 U.S.C. 154(b) by 0 days.

(21) Appl. No.: 10/603,907

(22) Filed: Jun. 25, 2003

(51) Int. Cl.[7] ..... B63B 35/44
(52) U.S. Cl. ..... 114/258; 114/259
(58) Field of Search ..... 114/254, 258, 114/259, 253, 260, 356, 357, 322; 440/38

(56) References Cited

U.S. PATENT DOCUMENTS

| | | | | |
|---|---|---|---|---|
| 2,748,740 A | | 6/1956 | Villar | |
| 3,448,712 A | | 6/1969 | Lehmann et al. | |
| 3,593,684 A | | 7/1971 | Cogliano | |
| 3,659,546 A | * | 5/1972 | Miklos | 114/246 |
| 3,757,722 A | | 9/1973 | Seiple | |
| 3,787,910 A | | 1/1974 | Taylor | |
| 3,796,175 A | | 3/1974 | Ford, Jr. et al. | |
| 3,937,163 A | * | 2/1976 | Rosenberg | 114/259 |
| 4,040,134 A | | 8/1977 | Downing | |
| 4,276,846 A | | 7/1981 | Anderson | |
| 4,295,236 A | | 10/1981 | Upchurch | |
| 5,188,054 A | | 2/1993 | Jacobs, Jr. | |
| 5,353,733 A | | 10/1994 | Evans | |
| 5,826,533 A | | 10/1998 | Stangroom et al. | |
| 5,997,217 A | | 12/1999 | Verret | |
| 6,178,914 B1 | | 1/2001 | Axelsson | |
| 6,359,833 B1 | | 3/2002 | English | |
| 6,367,406 B1 | * | 4/2002 | Sahr et al. | 114/357 |
| 2001/0010201 A1 | * | 8/2001 | Otterness | 116/173 |

FOREIGN PATENT DOCUMENTS

| | | |
|---|---|---|
| WO | WO/84 02504 | 7/1984 |

* cited by examiner

*Primary Examiner*—Stephen Avila
(74) *Attorney, Agent, or Firm*—Krieg DeVault Lundy LLP

(57) ABSTRACT

A towed raft has a generally U-shaped floating frame and a spine and rib assembly that substantially define a receiving area configured to receive a marine vessel substantially through an open end of the floating frame. At least one lifting device is mounted to said spine. The floating frame comprises a pair of floats connected by a cross brace at the forward end. The assembly comprises a spine spaced upwardly from the frame and generally longitudinally aligned with the receiving area, and a plurality of ribs extending generally outwardly and downwardly from the spine to connect the spine with the frame. The towed raft may be used for transport, launch or recovery of a marine vessel such as a swimmer delivery vehicle (SDV).

55 Claims, 5 Drawing Sheets

TOWED TRANSPORT, LAUNCH AND RECOVERY RAFT

DETAILED DESCRIPTION OF EMBODIMENTS OF THE INVENTION

Figure 1:
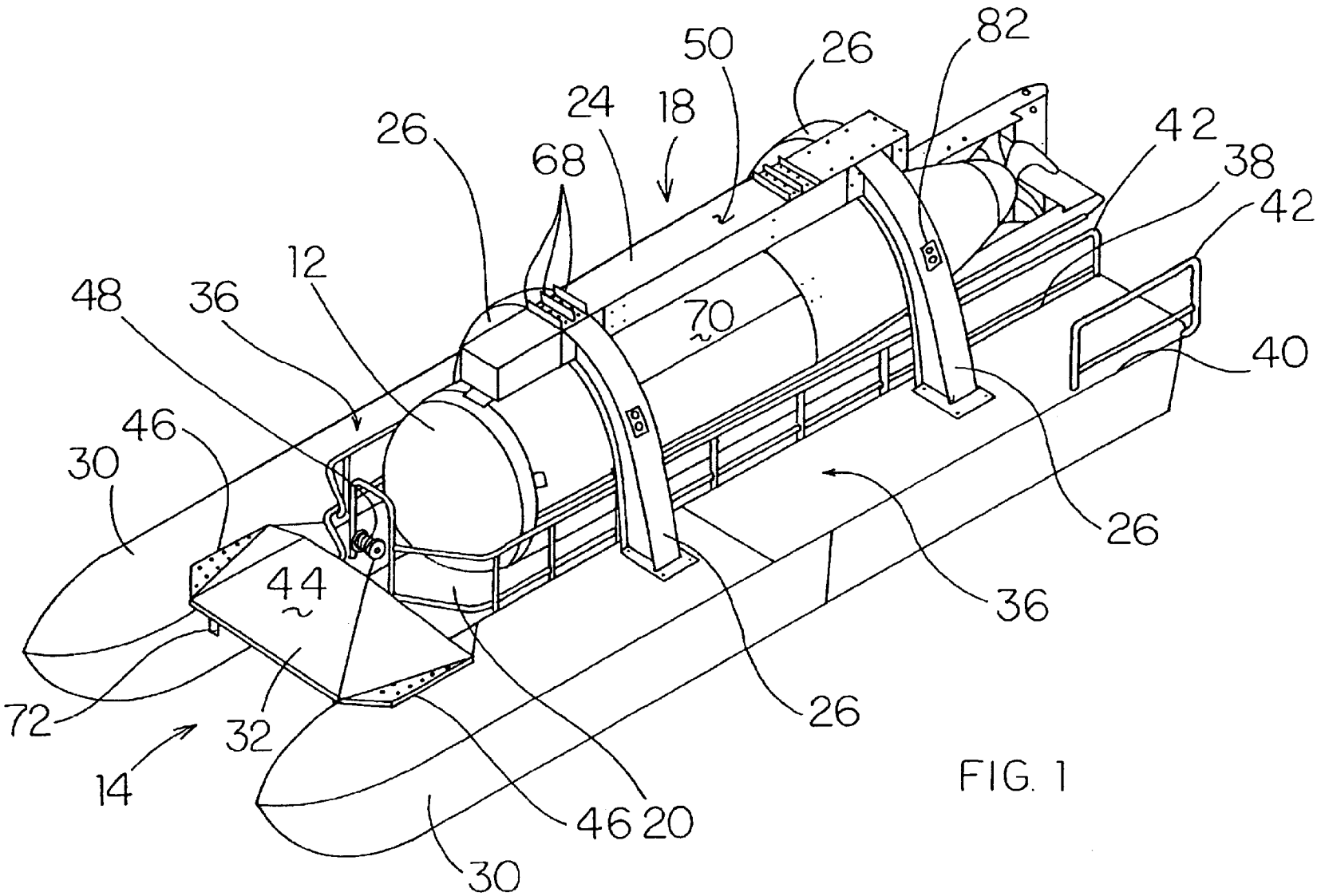
FIG. 1 illustrates a perspective view of an embodiment of a towed raft according to the present invention.
Figure 2:
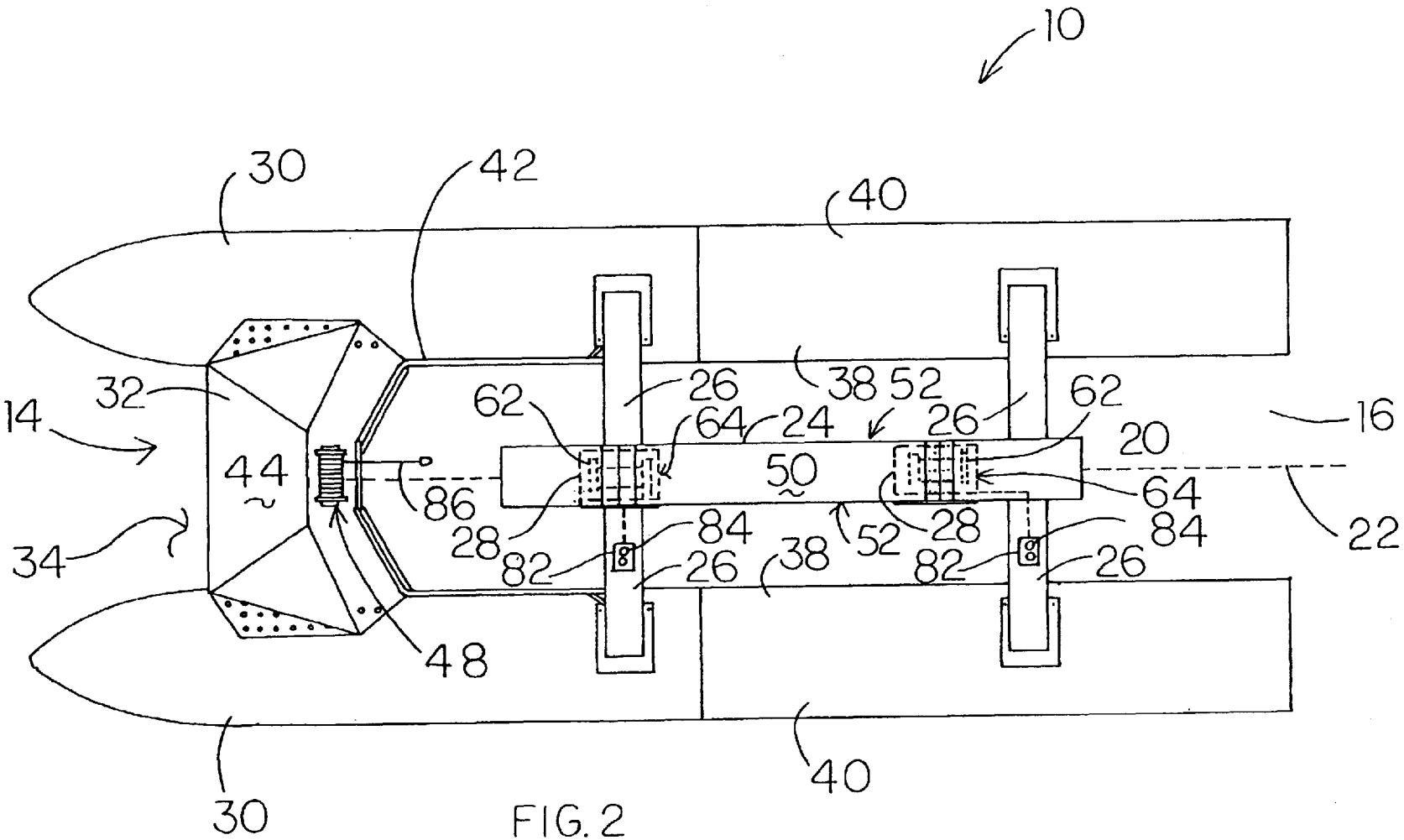
FIG. 2 illustrates a top view of an embodiment of a towed raft according to the present invention.

Embodiments of a towed raft 10 for transport, launch and recovery of a marine vessel 12 are shown in FIGS. 1–5. Referring to FIGS. 1 and 2, in one embodiment, the towed raft 10 comprises a generally U-shaped floating frame 14 having an open end 16, and a spine and rib assembly 18 connected thereto. A receiving area 20 is generally defined laterally by the floating frame 14, and upwardly by the spine and rib assembly 18. During use, the receiving area 20 is also downwardly defined by the level of water (not shown) on which the towed raft 10 is located for use. The receiving area 20 is configured to receive a marine vessel, 12 therein, substantially through the open end 16 of the floating frame 14.

In one embodiment, the receiving area 20 has a longitudinal centerline 22 substantially aligned with the longitudinal axis of the towed raft 10. In other embodiments, the spine and rib assembly 18 comprises a spine 24 upwardly spaced from the floating frame 14 and substantially aligned with the longitudinal centerline 22. In yet other embodiments, the assembly 18 further comprises a plurality of ribs 26 that connect the spine 24 to the frame 14. In yet other embodiments, the ribs 26 extend generally outwardly and downwardly from the spine 24 to the floating frame 14. One or more lifting devices 28 may be secured to the towed raft 10. In one embodiment, each lifting device 28 is adapted to lift, lower and retain a marine vessel 12 relative to the receiving area 20. In other embodiments, the lifting devices 28 are able to retain a marine vessel 12 within the receiving area 20 having an underside clearance from the water level of between about 10 inches and about 30 inches.

As shown in FIG. 2, the floating frame 14 in one embodiment comprises a pair of spaced-apart floats 30 connected by a cross brace 32 at a forward end 34 of the frame 14 that is opposite the open end 16. In other embodiments, the floats 30 are substantially parallel. In yet other embodiments, the longitudinal centerline 22 of the receiving area 20 is substantially equidistant between the floats 30.

Each float 30 may have construction as desired suitable for the purposes of the present invention. In one embodiment, each float 30 comprises a pontoon hull float. In other embodiments, each float 30 comprises a catamaran hull float. In yet other embodiments, ea ch float 30 comprises a hull manufactured of aluminum or fiberglass material.

As shown in FIGS. 2–5, the floats 30 may be adapted as desired for use of the towed raft 10. In one embodiment, one or both floats 30 comprise a substantially flat upper surface 36 adapted for occupancy by one or more crew members (not shown) manning the towed raft 10. The flat upper surfaces 36 have an inside perimeter 38 adjacent to the receiving area 20 and an outside perimeter 40 generally on the outside of the towed raft 10. In other embodiments, at least one generally upstanding railing 42 extends substantially along the inside perimeter 38 of each float 30 having a flat upper surface 36. In yet other embodiments, at least one generally upstanding railing 42 extends along at least one portion of the outside perimeter 40. In yet other embodiments, generally upstanding railings 42 are configured according to rules, regulations or other standards in the marine industry.

Referring now to FIGS. 1 and 2, the cross brace 32 at the forward end 34 of the frame 14 may have any configuration suitable for rigidly connecting the pair of floats 30 in the floating frame. In one embodiment, the cross brace 32 comprises a rigid flat or multi-faceted sheet 44 extending between the floats 30 and secured thereto at opposite ends 46 of the sheet. In other embodiments, the sheet 44 has a length sufficient to space the floats 30 apart sufficiently to define the receiving area 20 sized as desired to receive a marine vessel 12. In yet other embodiments, a tow winch 48 is secured to the cross brace 32, the tow winch 48 being adapted to tow a marine vessel 12 into position for recovery of the vessel into the receiving area 20 prior to lifting by the lifting device 28.

Figure 3:
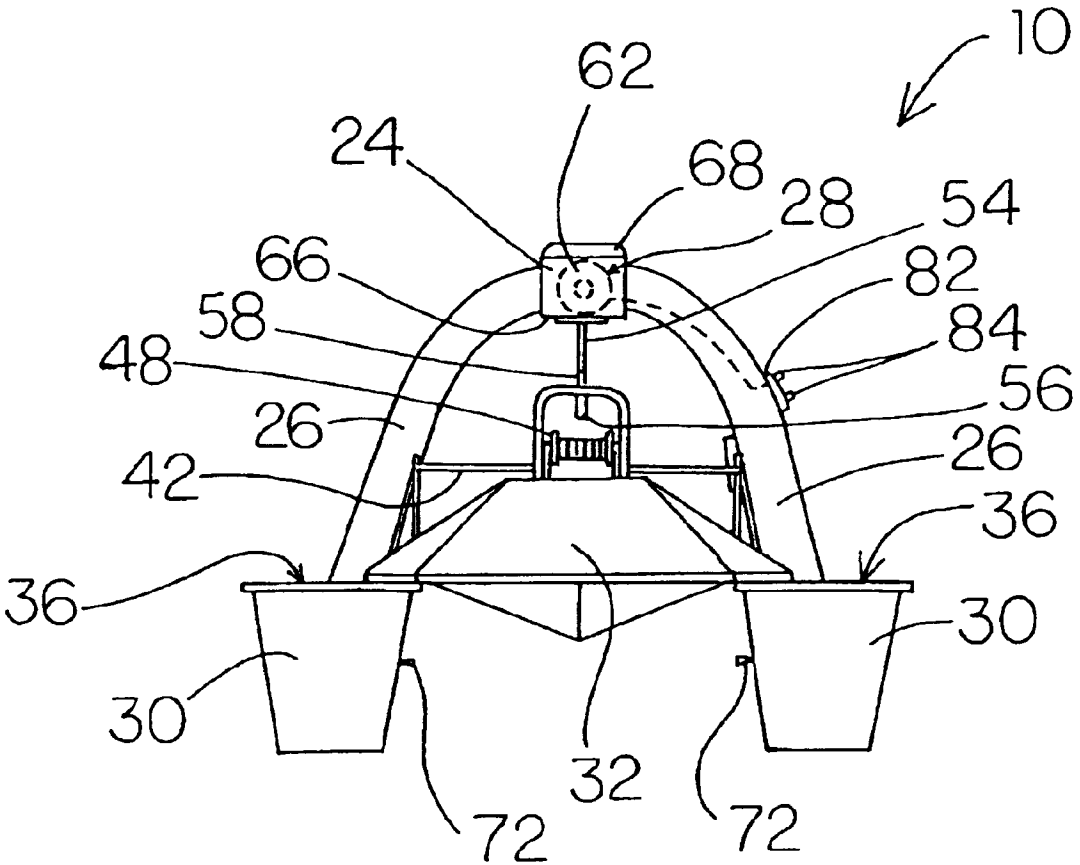
FIG. 3 illustrates a front view of an embodiment of a towed raft according to the present invention.
Figure 4:
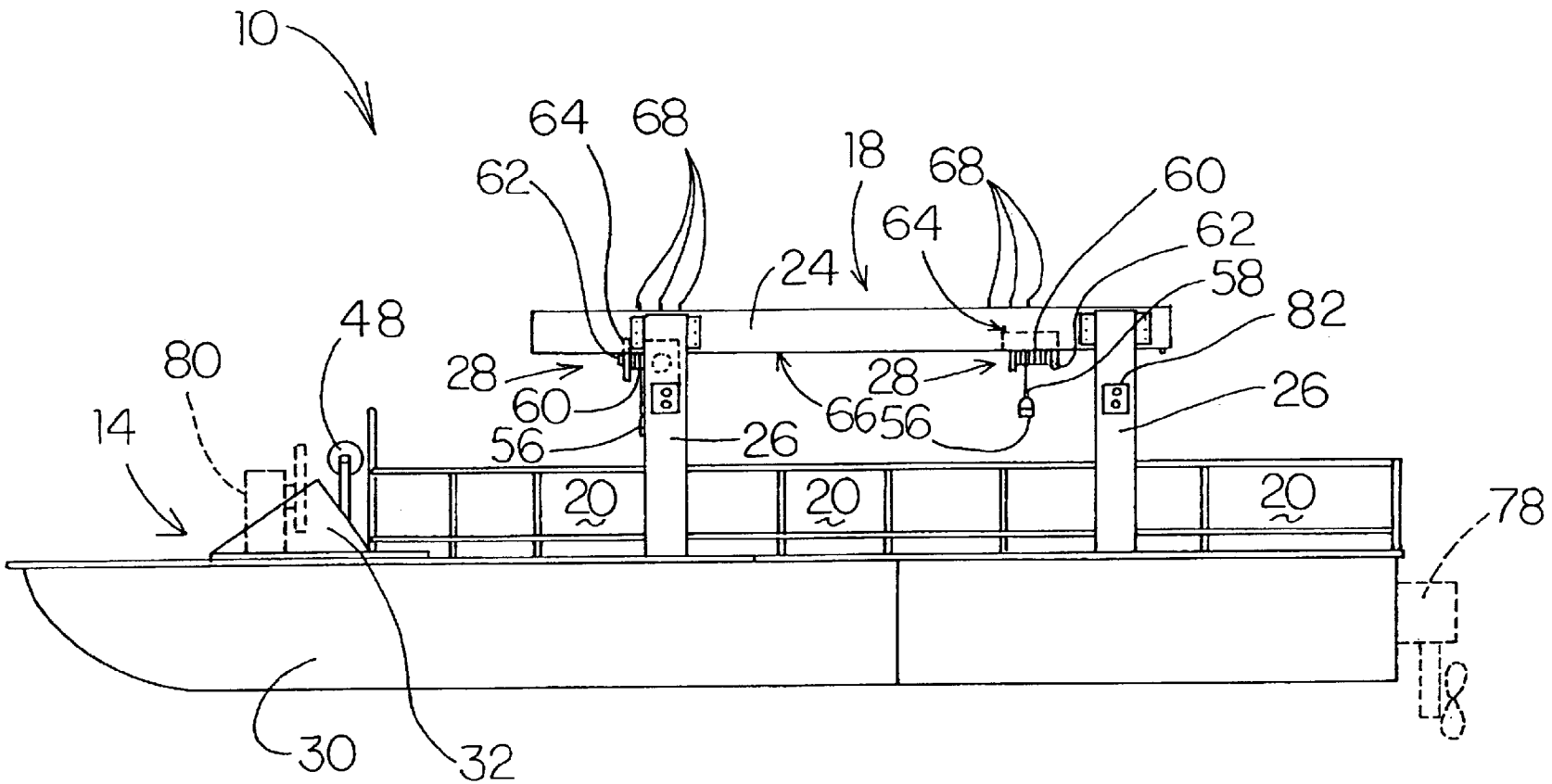
FIG. 4 illustrates a side view of an embodiment of a towed raft according to the present invention.

Referring now to FIGS. 2–4, the spine and rib assembly 18 upwardly defines the receiving area 20. In one embodiment, the spine 24 comprises a generally longitudinal beam 50 spaced above the floating frame 14 and substantially aligned with the longitudinal centerline 22. In other embodiments, at least two pairs of ribs 26 connect the spine 24 to the floating frame 14. In yet other embodiments, the ribs 26 in each pair extend generally outwardly and downwardly from the spine 24 on laterally opposite sides 52 of the spine. In yet other embodiments, the pairs of ribs 26 comprise an arched connection of the spine 24 to the floating frame 14. In yet other embodiments, at least one lifting device 28 is provided corresponding to each pair of ribs 26.

A lifting device 28 can be any device suitable for releasably connecting to a marine vessel 12 and launching or recovering and retaining the vessel relative to the receiving area 20. In one embodiment, a lifting device 28 comprises a cable 54 having a hook or other connecting device 56 at a distal end 58 of the cable and a connected end 60 wound about a reel 62. In other embodiments, the reel 60 has operative controls 64 for winding and unwinding the cable 54 about the reel. In yet other embodiments, operative controls 64 comprise a manual winch or a motorized winch. In yet other embodiments, operative controls 64 comprise at least one hydraulic lift cylinder. In yet other embodiments, each lifting device 28 is adapted to raise and lower loads of up to about 7,500 pounds.

A lifting device 28 may be secured to the spine 24 by any suitable means at any suitable position for the purposes of the present invention. In one embodiment, each lifting device 28 is secured to the underside 66 of the spine 24 in spaced relation to each other lifting device, if any. In other embodiments, each lifting device 28 is secured within the spine 24 and the cable 54 extends generally downwardly from the underside 66 of the spine. In yet other embodiments, rigid support elements 68 are secured to the spine 24 generally adjacent the location of each lifting device 28. The support elements 68 may be adapted to provide additional structural support to the spine 24 during launch, recovery, lifting and retention of a marine vessel 12 by the lifting devices 28.

The dimensions of a towed raft 10 according to the embodiments of the present invention are determined according to the towing limitations of a user of the raft and according to the size of the marine vessel 12 used in connection with the towed raft. In one embodiment, the towed raft 10 has a length of between about 25 feet and about 40 feet. In other embodiments, the length is about 33½ feet. In yet other embodiments, the towed raft 10 has a width of between about 8 feet and about 15 feet. In yet other embodiments, the width is about 12½ feet. In yet other embodiments, the towed raft 10 has a dry-dock height of between about 6 feet and about 15 feet. In yet other embodiments, the dry-dock height is about 8 ¾feet.

The marine vessel 12 used in connection with the embodiments of the towed raft 10 may be any vessel having short-range uses for which transport to the location of such uses is desirable. In one embodiment, the marine vessel 12 comprises a swimmer delivery vehicle 70. In other embodiments, the swimmer delivery vehicle 70 has a passenger capacity of between 2 and 10.

Figure 5:
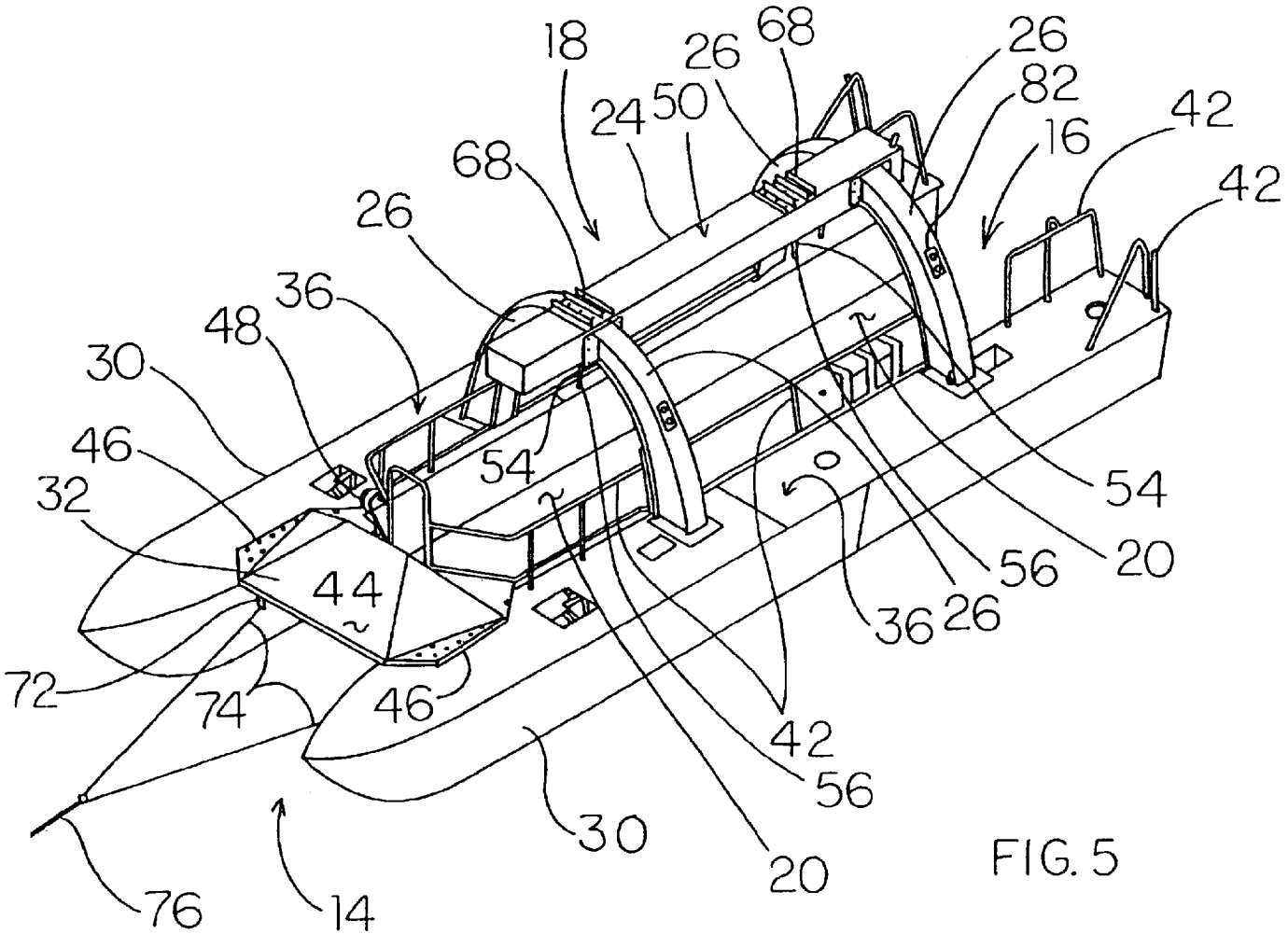
FIG. 5 illustrates a perspective view of another embodiment of a towed raft according to the present invention.

As shown in FIGS. 1, 3 and 5, in one embodiment, the towed raft 10 has one or more tow-line connection points 72 located generally at the forward end 34 of the floating frame 14. In other embodiments, tow-line connection points 72 are located on each float 30 adjacent opposite ends 46 of the cross brace 32. In yet other embodiments, the tow-line connection points 72 are configured to receive distal connections 74 from a tow line 76 extending from a tow craft (not shown). In yet other embodiments, the towed raft 10 may be towed by the tow craft at a speed up to about 18 knots with a marine vessel 12 retained within the receiving area 20.

For lifting devices 28 comprising non-manual operative controls, a power source (not shown) may be provided for powering the lifting device. In one embodiment, the power source comprises a battery-stored power source. In other embodiments, the battery-stored power source has a power storage capacity sufficient for at least two repetitions of a set of lowering and lifting a marine vessel 12 relative to the receiving area 20.

As shown in FIG. 4 in broken-line form, in some embodiments of a towed raft 10, it may be desirable to provide mechanical means 78 for propelling the raft 10 along a body of water (not shown). In one embodiment, mechanical means 78 for propelling the raft 10 comprise either a marine outboard motor, a water jet motor, or a diesel motor that is operatively connected to a propeller assembly. In other embodiments, steering means 80 for navigating the towed raft 10 with mechanical means 78 for propelling it are also provided. In yet other embodiments, the steering means 80 is mounted at the forward end 34 of the floating frame 14.

The receiving area, 20 defined by the floating frame 14 and the spine and rib assembly 18 is configured to receive a marine vessel 12 therein. In one embodiment, the receiving area 20 has a height at the longitudinal centerline 22 from the bottom of the spine 24 to the level of the water between about 6 feet and about 12 feet. In other embodiments, the receiving area 20 has a width between the floats 30 of between about 8 feet and about 15 feet. In yet other embodiments, the receiving area 20 has a length from the cross brace 32 to the open end 16 between about 15 feet and about 32 feet. In yet other embodiments, the receiving area 20 has dimensions of about 6 feet in height at the longitudinal centerline 22, about 8 feet wide, and about 28 feet long. In yet other embodiments, the receiving area 20 has a volumetric capacity of between about 720 cubic feet and about 5,760 cubic feet. In yet other embodiments, the receiving area 20 has a volumetric capacity of about 1,344 cubic feet.

In operation, a marine vessel 12 is retained within the receiving area 20 with clearance above the water level of about 24 inches. The towed raft 10 is then towed by a tow craft to transport the vessel 12 to a desired location. At that location, launch of the vessel 12 is achieved by generally simultaneously unwinding the cables 54 of each lifting device 28 using the operative controls 64. In one embodiment, a control panel 82 is provided with each lifting device 28 having at least two controllers 84, one for extending (unwinding or lowering) the cable 54, the other for retracting (winding or lifting) the cable 54. The cables 54 are extended until the vessel 12 is substantially buoyantly supported in the water. The hooks, 56 at the distal ends 58 of the cables, 54 are then disconnected from the vessel 12. In one embodiment, launch may occur while the towed raft 10 is being towed by a tow craft at up to about 2 knots. The vessel 12 then navigates clear of the towed raft 10.

Recovery of the vessel 12 is achieved by positioning the vessel such that the lifting device cables 54 and hooks 56 may be reconnected to the vessel. In one embodiment, a recovery line 86 extending from the tow winch 48 secured to the cross brace 32 is connected to a tow bridle (not shown) at the forward end of the vessel 12. The tow winch 48 is operated to position the vessel 12 generally within the U-shaped floating frame 14 so that the cable hooks 56 may be reconnected to the vessel. The vessel 12 is then lifted out of the water by the lifting devices 28. In one embodiment, recovery may occur while the towed raft 10 is being towed by a tow craft at up to about 2 knots.

One or more crew members (not shown) may man the towed raft 10 for achieving appropriate launch and recovery activities as described above. Crew members generally remain on the substantially flat upper surfaces 36 of the floats 30. Railings 42 are provided for preventing unintentional entry into the receiving area 20 or for holding onto by crew members as the towed raft 10 floats on a body of water.

While specific embodiments of the invention have been shown and described herein for purposes of illustration, the protection offered by any patent which may issue upon this application is not strictly limited to the disclosed embodiments; but rather extends to all structures, steps and arrangements which fall fairly within the scope of the claims which are appended hereto:

What is claimed is:

1. A towed raft comprising: a receiving area substantially defined laterally by a generally U-shaped floating frame having an open end, and upwardly by a spine and rib assembly connected to said frame, said receiving area being configured to receive a marine vessel therein substantially through said open end, said receiving area having a longitudinal centerline, said spine and rib assembly having a spine upwardly spaced from said frame and substantially aligned with said longitudinal centerline, and a plurality of ribs connecting said spine to said frame, said ribs extending generally outwardly and downwardly from said spine, and at least one lifting device secured to said spine, said lifting device being adapted to lift out of the water in which said raft floats in recovery, lower into said water in launch, and retain out of said water and over said receiving area in the transport of said marine vessel.

2. The towed raft of claim 1 wherein said U-shaped floating framed comprises a pair of spaced apart floats connected by a cross brace at a forward end of said frame opposite said open end.

3. The towed raft of claim 2 wherein said floats are substantially parallel, said longitudinal centerline being generally equidistant between said floats.

4. The towed raft of claim 2 further comprising a tow winch secured to said cross brace, said winch adapted to tow said marine vessel into position for recovering said marine vessel by said lifting device.

5. The towed raft of claim 1 wherein said lifting device retains said marine vessel within said receiving area with clearance of an underside of said marine vessel above the level of water in which said apparatus floats between about 10 inches and about 30 inches.

6. The towed raft of claim 1 wherein said assembly comprises at least two pairs of ribs, each said pair comprising ribs extending generally outwardly and downwardly from said spine from generally opposite sides of said spine.

7. The towed raft of claim 6 wherein one said lifting device is provided on said spine corresponding to each said pair of ribs.

8. The towed raft of claim 1 wherein each said lifting device comprises a cable having a hook at a distal end thereof and having a connected end wound about a reel, said reel having operative controls for winding and unwinding said cable.

9. The towed raft of claim 8 wherein said operative controls comprise a manual winch.

10. The towed raft of claim 8 wherein said operative controls comprise at least one hydraulic lift cylinder.

11. The towed raft of claim 8 wherein said operative controls comprise a motorized winch.

12. The towed raft of claim 8 wherein each said lifting device is mounted within said spine, said cable and said distal end extending generally downwardly from said spine.

13. The towed raft of claim 1 wherein said frame has a length of between about 25 feet and about 40 feet.

14. The towed raft of claim 13 wherein said length is about 33½ feet.

15. The towed raft of claim 1 wherein said frame has a width of between about 8 feet and about 15 feet.

16. The towed raft of claim 15 wherein said width is about 12½ feet.

17. The towed raft of claim 1 wherein said frame and said assembly have a dry-dock height of between about 6 feet and about 15 feet.

18. The towed raft of claim 17 wherein said dry-dock height is about 8¾ feet.

19. The towed raft of claim 1 further comprising a battery stored power source for operating said lifting device.

20. The towed raft of claim 19 wherein said battery-stored power source has a power storage capacity sufficient for at least 2 repetitions of a set of lowering and lifting said marine vessel.

21. The towed raft of claim 1 wherein each said lifting device is adapted to raise and lower loads of up to about 7500 pounds.

22. The towed raft claim 1 adapted to be towed at speeds up to about 18 knots with said marine vessel retained within said receiving area.

23. The towed raft of claim 1 wherein said marine vessel comprises a swimmer delivery vehicle.

24. The towed raft of claim 23 wherein said swimmer delivery vehicle has a passenger capacity of between 2 and 10.

25. The towed raft of claim 2 wherein each said float comprises a hull manufactured of aluminum.

26. The towed raft of claim 2 wherein each said float comprises a hull manufactured of fiberglass.

27. The towed raft of claim 2 wherein each said float comprises a pontoon hull float.

28. The towed raft of claim 2 wherein each said float comprises a catamaran hull float.

29. The towed raft of claim 2 wherein each said float comprises a substantially flat upper surface adapted for occupancy by at least one crew member.

30. The towed raft of claim 29 wherein each said flat upper surface has an inside perimeter and an outside perimeter, said inside perimeter being adjacent said receiving area, said towed raft further comprising at least one generally upstanding railing extending substantially a long said inside perimeter of each said float.

31. The towed raft of claim 30 further comprising at least one generally upstanding railing extending along at least one portion of said outside perimeter.

32. The towed raft of claim 1 further comprising mechanical means for propelling said towed raft along a body of water.

33. The towed raft of claim 32 wherein said mechanical means for propelling comprises either a marine outboard motor, a water jet motor or a diesel motor operatively connected to a propeller assembly.

34. The towed raft of claim 32 further comprising steering means for navigating said towed raft.

35. The towed raft of claim 34 wherein said steering means is mounted at a forward end of said towed raft opposite said open end.

36. The towed raft of claim 1 wherein said frame and said assembly define said receiving area having a volumetric capacity of between about 720 cubic feet and about 5,760 cubic feet.

37. The towed raft of claim 36 wherein said capacity is about 1,344 cubic feet.

38. The towed raft of claim 6 wherein each said pair comprises a generally arched construction connecting said spine to said frame.

39. The towed raft of claim 1 wherein said spine comprises a generally longitudinal beam spaced above said frame, said ribs extending generally outwardly and downwardly from said beam on laterally opposite sides thereof to said frame.

40. The towed raft of claim 39 wherein each said lifting device is mounted to the underside of said beam.

41. The towed raft of claim 39 further comprising a plurality of rigid support elements secured to said beam generally adjacent each said lifting device, said rigid support elements being adapted for providing structural support to said beam during use of said lifting devices.

42. The towed raft of claim 8 further comprising a control panel operatively connected to said operative control for each said lifting device, said control panel having a plurality of controllers mounted thereon for selectively extending and retracting said cable.

43. The towed raft of claim 2 wherein said cross brace comprises a rigid sheet extending between said floats and secured to said floats generally at opposite ends of said sheet.

44. The towed raft of claim 1 further comprising at least one tow-line connection point secured generally at a forward end of said frame opposite said open end.

45. The towed raft of claim 2 further comprising a pair of tow-line connection points, one and the other said connection points being secured on one and the other said floats, respectively, generally at opposite ends of said cross brace.

46. The towed raft of claim 44 or claim 45 wherein each said connection point is configured to receive a distal connector from a tow line extending rearwardly from a tow craft.

47. The towed raft of claim 1 wherein said receiving area has a height through said longitudinal centerline of between about 6 feet and about 12 feet.

48. The towed raft of claim 47 wherein said height is about 8 feet.

49. The towed raft of claim 1 wherein said receiving area has a width defined by said frame of between about 8 feet and about 15 feet.

50. The towed raft of claim 49 wherein said width is about 8 feet.

51. The towed raft of claim 1 wherein said receiving area has a length from a forward end within said frame to said open end of between about 15 feet and about 32 feet.

52. The towed raft of claim 51 wherein said length is about 28 feet.

53. The towed raft of claim 1 wherein said receiving area has a height through said longitudinal centerline of about 8 feet, a width defined by said frame of about 8 feet, and a length from a forward end within said frame to said open end of about 28 feet.

54. A towed raft comprising: a receiving area substantially defined laterally by a generally U-shaped floating frame having an open end, and upwardly by a spine and rib assembly connected to said frame, said receiving area being configured to receive a marine vessel therein substantially through said open end, said receiving area having a longitudinal centerline, said spine and rib assembly having a spine upwardly spaced from said frame and substantially aligned with said longitudinal centerline, and a plurality of ribs connecting said spine to said frame, said ribs extending generally outwardly and downwardly from said spine, and at least one lifting device secured to said spine, said lifting device being adapted to lift, lower and retain said marine vessel, said assembly comprises at least two pairs of ribs, each said pair comprising ribs extending generally outwardly and downwardly from said spine from generally opposite sides of said spine.

55. A towed raft comprising: a receiving area substantially defined laterally by a generally U-shaped floating frame having an open end, and upwardly by a spine and rib assembly connected to said frame, said receiving area being configured to receive a marine vessel therein substantially through said open end, said receiving area having a longitudinal centerline, said spine and rib assembly having a spine upwardly spaced from said frame and substantially aligned with said longitudinal centerline, and a plurality of ribs connecting said spine to said frame, said ribs extending generally outwardly and downwardly from said spine, and at least one lifting device secured to said spine, said lifting device being adapted to lift, lower and retain said marine vessel, adapted to be towed at speeds up to about 18 knots with said marine vessel retained within said receiving area.

* * * * *